US006450581B1

(12) United States Patent
Koerlin

(10) Patent No.: US 6,450,581 B1
(45) Date of Patent: Sep. 17, 2002

(54) POWER LEGREST FOR A WHEELCHAIR

(75) Inventor: James M. Koerlin, Broomfield, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 09/676,254

(22) Filed: Sep. 29, 2000

(51) Int. Cl.[7] ..... A47C 20/00; A47C 7/50
(52) U.S. Cl. ..... 297/423.26; 297/423.38
(58) Field of Search ..... 297/423.3, 423.31, 297/423.26, 423.38

(56) References Cited

U.S. PATENT DOCUMENTS

| | | | | | |
|---|---|---|---|---|---|
| 2,849,051 | A | * | 8/1958 | Streeter, III | 297/423.26 X |
| 3,189,385 | A | * | 6/1965 | Mommsen | 297/423.26 |
| 3,220,022 | A | * | 11/1965 | Nelson | 297/423.3 X |
| 3,574,399 | A | | 4/1971 | Udden | |
| 3,858,938 | A | * | 1/1975 | Kristensson et al. | 297/423.26 X |
| 4,012,074 | A | * | 3/1977 | O'Rielly | 297/423.33 X |
| 4,176,879 | A | * | 12/1979 | Rodaway | 297/423.26 X |
| 4,339,013 | A | | 7/1982 | Weigt | |
| 4,730,842 | A | * | 3/1988 | Summers et al. | 297/423.26 X |
| 4,790,533 | A | | 12/1988 | Okamoto | |
| 4,887,826 | A | * | 12/1989 | Kantner | 297/423.26 X |
| 5,209,509 | A | | 5/1993 | Gay et al. | |
| 5,297,021 | A | | 3/1994 | Koerlin et al. | |
| 5,328,247 | A | * | 7/1994 | Lovins | 297/423.3 |
| 5,352,020 | A | * | 10/1994 | Wade et al. | 297/423.26 |
| 5,480,172 | A | | 1/1996 | James | |
| 6,168,238 | B1 | * | 1/2001 | Hannagan | 297/423.3 |

FOREIGN PATENT DOCUMENTS

| | | | | |
|---|---|---|---|---|
| FR | 2553650 | * | 4/1985 | 297/423.26 X |
| FR | 2654334 | | 5/1991 | |
| GB | 2157557 A | | 10/1985 | |

* cited by examiner

*Primary Examiner*—Daniel P. Stodola
*Assistant Examiner*—Hugh B. Thompson
(74) *Attorney, Agent, or Firm*—MacMillan, Sobanski & Todd, LLC

(57) ABSTRACT

A wheelchair has a seat frame, legrests pivotally mounted for elevation with respect to the seat frame, and an elevation mechanism. The elevation mechanism includes a latch link having a legrest end attached to the legrest, and a pivot end. Also included is a pivot link having a frame end pivotally connected to the seat frame, and having a latch link end pivotally connected to the pivot end of the latch link., The latch link end of the pivot link and the pivot end of the latch link are pivotally connected through a latch pin. An actuator having a piston movable in forward and rearward directions with respect to the seat frame is provided to pivot the legrests relative to the seat frame, the piston having a forward end that is connected to one of the latch pin, the latch link, and the pivot link.

34 Claims, 7 Drawing Sheets

POWER LEGREST FOR A WHEELCHAIR

TECHNICAL FIELD

The present invention relates to wheelchairs, and particularly to wheelchairs capable of moving the seat and back for tilting and reclining. More particularly, the invention pertains to wheelchairs having legrests capable of being raised to support the legs of the wheelchair user.

BACKGROUND OF THE INVENTION

Wheelchairs often have a fixed seat consisting of a seating surface and a back frame. The seating surface is usually either horizontal or slightly tilted back, with the front edge of the seating surface slightly higher than the rear edge of that surface. If the wheelchair user sits in the same position in a wheelchair for a long period of time, pressure is continuously applied to the tissue on the portion of the user's body (buttocks, legs, and/or back) that is bearing the user's weight in that position. Blood circulation to that tissue will be reduced, and ulcers or other problems can result.

To avoid these problems, it is necessary for people sitting in wheelchairs to shift their body weight from time to time. This is often accomplished by tilting the seat portion of the wheelchair backwards so that the user's weight is shifted away from the pressure points on the user's body. Also, the user's weight can be shifted by reclining the back frame. During the recline process it is preferable to raise the user's legs by raising the legrest. Power elevating legrests are known, and they are typically driven by linear actuators. A means for raising the legrests on a power wheelchair is disclosed in U.S. Pat. No. 5,297,021 to Koerlin et al.

Where a wheelchair is provided with a legrest, it is desirable to provide the legrest with a swingaway feature so that the legrests can be removed or swung out of the way to make it easier for the user to have access to or egress from the wheelchair. A particularly useful swingaway footrest is disclosed in U.S. Pat. No. 4,790,533 to Okamoto.

One of the problems of elevating legrests is that the legrests are typically not very substantial, giving the wheelchair user an insecure feeling. This is even a problem in power wheelchairs. It would be advantageous if there could be developed a power elevating legrest having robust characteristics. Further, it would be helpful to have a power elevating legrest with a simple to use swingaway feature to enable easy access by the wheelchair user. Another problem with existing power elevating legrests is that the linear actuators used to elevate the legrests typically end up with poorly oriented loading, resulting in badly leveraged configurations. An ideal power elevating legrest would make the maximum use of leverage for an efficient use of power and for the most compact arrangement possible.

SUMMARY OF THE INVENTION

The above objects as well as other objects not specifically enumerated are achieved by a wheelchair having a seat frame, legrests pivotally mounted for elevation with respect to the seat frame, and an elevation mechanism. The elevation mechanism includes a latch link having a legrest end attached to the legrest, and a pivot end. Also included is a pivot link having a frame end pivotally connected to the seat frame, and having a latch link end pivotally connected to the pivot end of the latch link. The latch link end of the pivot link and the pivot end of the latch link are pivotally connected through a latch pin. An actuator having a piston movable in forward and rearward directions with respect to the seat frame is provided to pivot the legrests relative to the seat frame, the piston having a forward end that is connected to one of the latch pin, the latch link, and the pivot link.

According to this invention, there is also provided a wheelchair having a seat frame and legrests pivotally mounted for elevation with respect to the seat frame, in which the pivotal mounting of the legrests with respect to the base includes a pivot bracket that enables a legrest pivot pin to be vertically adjusted relative to the seat frame.

Various objects and advantages of this invention will become apparent to those skilled in the art from the following detailed description of the preferred embodiment, when read in light of the accompanying drawings.

DETAILED DESCRIPTION OF THE INVENTION

Figure 1:
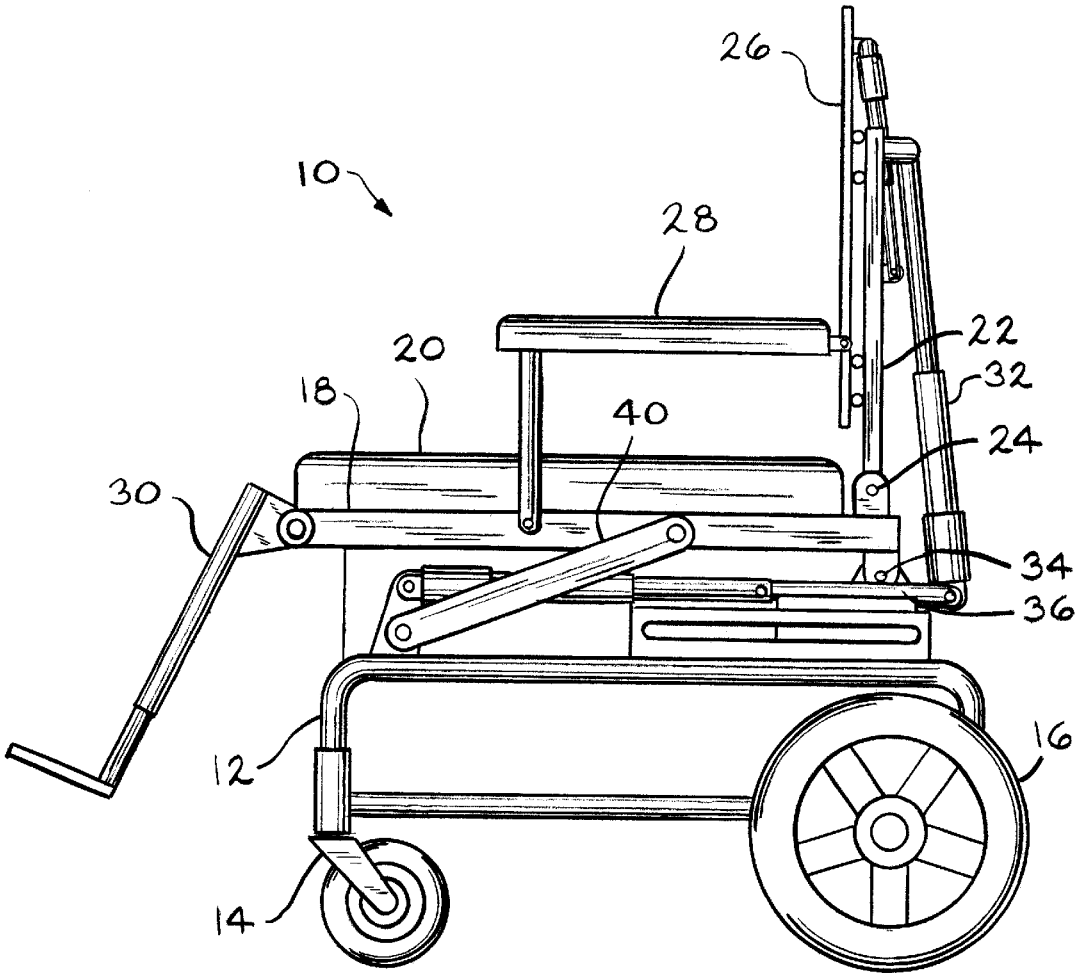
FIG. 1 is a schematic view in elevation of a wheelchair having a power elevating legrest of the invention.
Figure 2:
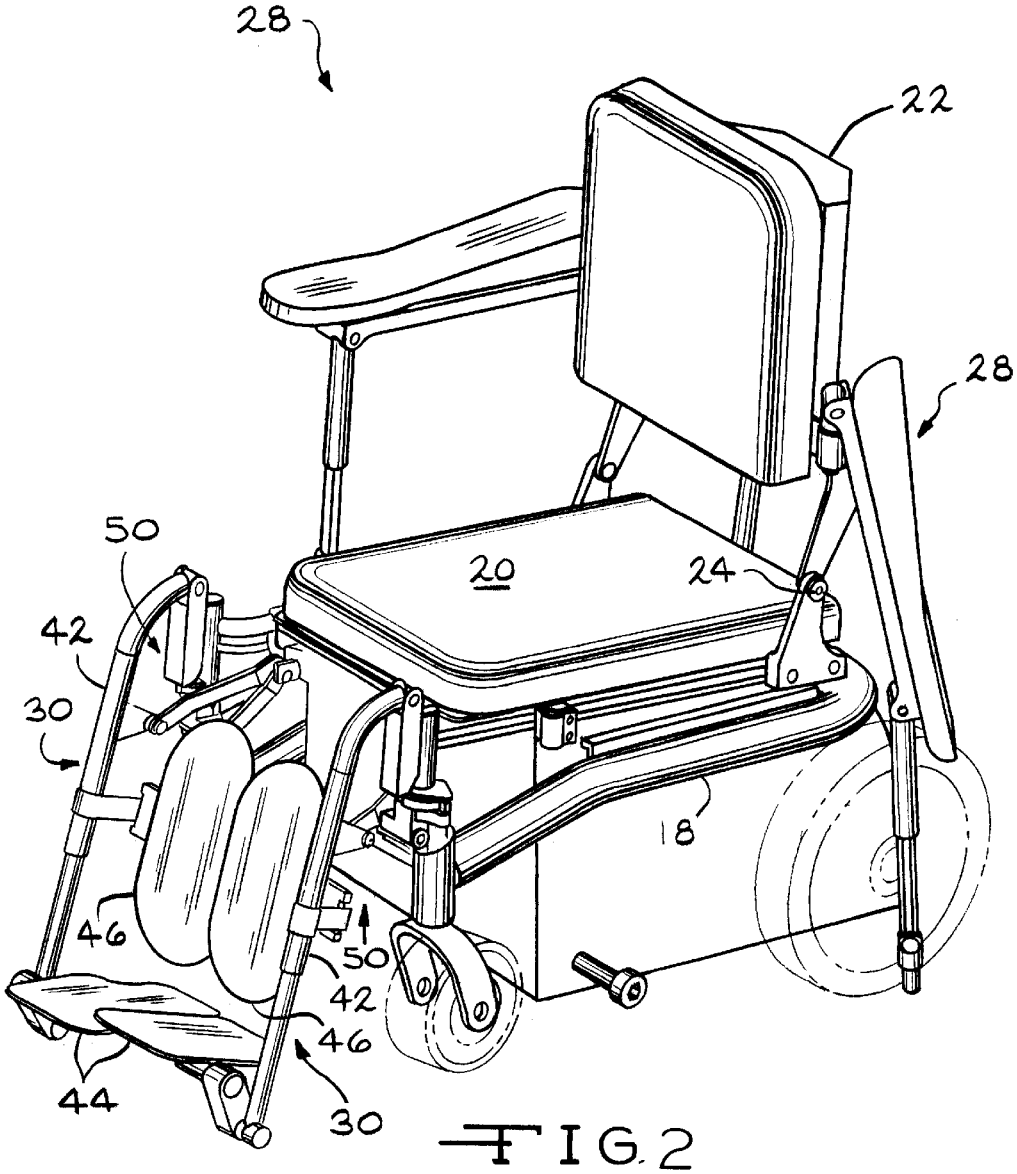
FIG. 2 is a schematic view in perspective of the wheelchair of the invention.

As shown in FIGS. 1 and 2, a wheelchair indicated generally at 10 is comprised of a wheelchair base 12, which is mounted for movement on front caster wheels 14 and rear drive wheels 16. The wheelchair is preferably provided with a drive motor, not shown, for each of the drive wheels, and a source of power for the drive motors, also not shown. A seat frame 18 supports a seat cushion 20 for the support of the user. A back frame 22 is provided to support the user's body. The back frame 22 is pivotally mounted for reclining about pivot point 24. The back frame 22 can be provided with a shear plate 26 to accommodate the shear forces involved when the wheelchair is reclined. The shear plate 26 can be any suitable back support member, many types of which are well known to those skilled in the art, and can be provided with a cushion, not shown. A shear plate actuator, not shown, can be connected to the shear plate and the back frame to move the shear plate with respect to the back frame. The movement of the shear plate is up and down with respect to the back frame when the back frame is in a vertical orientation. More precisely the movement of the shear place is toward or away from the recline pivot point 24. The user's arms can be supported by armrests indicated at 28. Leg rests 30 can also be provided. An actuator 32 can be positioned to recline the back frame 22 as required by the wheelchair user.

The seat frame is mounted for rotation or tilting in a clockwise direction (as viewed in FIG. 1) so that the wheelchair user can be tipped back to shift the user's weight for comfort purposes and to relieve pressure from various body parts. Numerous methods of and configurations for tilting the seat frame with respect to the wheelchair base 12 are known to those skilled in the art. In the embodiment shown in FIG. 1, the seat frame 18 is pivotally mounted to tilt about pivot point 34. The pivot point 34 can be optionally attached to a carriage 36 which is mounted for a sliding forward and rearward movement along a track or glide fixed to the wheelchair base 12. Any other type of sliding movement can be used. Preferably, the carriage is moved by means of an actuator. As the carriage 36 is moved forward within the glide, the tilt pivot point 34, and hence the seat frame 18, is pulled forward with respect to the wheelchair base 12. A tilt linkage 40 hingedly connects the seat frame 18 to the wheelchair base 12. As the carriage slides forward, the tilt linkage 40 pushes up the front of the seat frame 18.

As shown in FIG. 2 the legrests 30 include legrest tubes 42, footrests 44 and leg support plates 46. These are preferably configured for adjustment to accommodate the needs of the wheelchair user. The wheelchair legrest elevation mechanism, indicated generally at 50, is provided to elevate the legrests 30.

Figure 3:
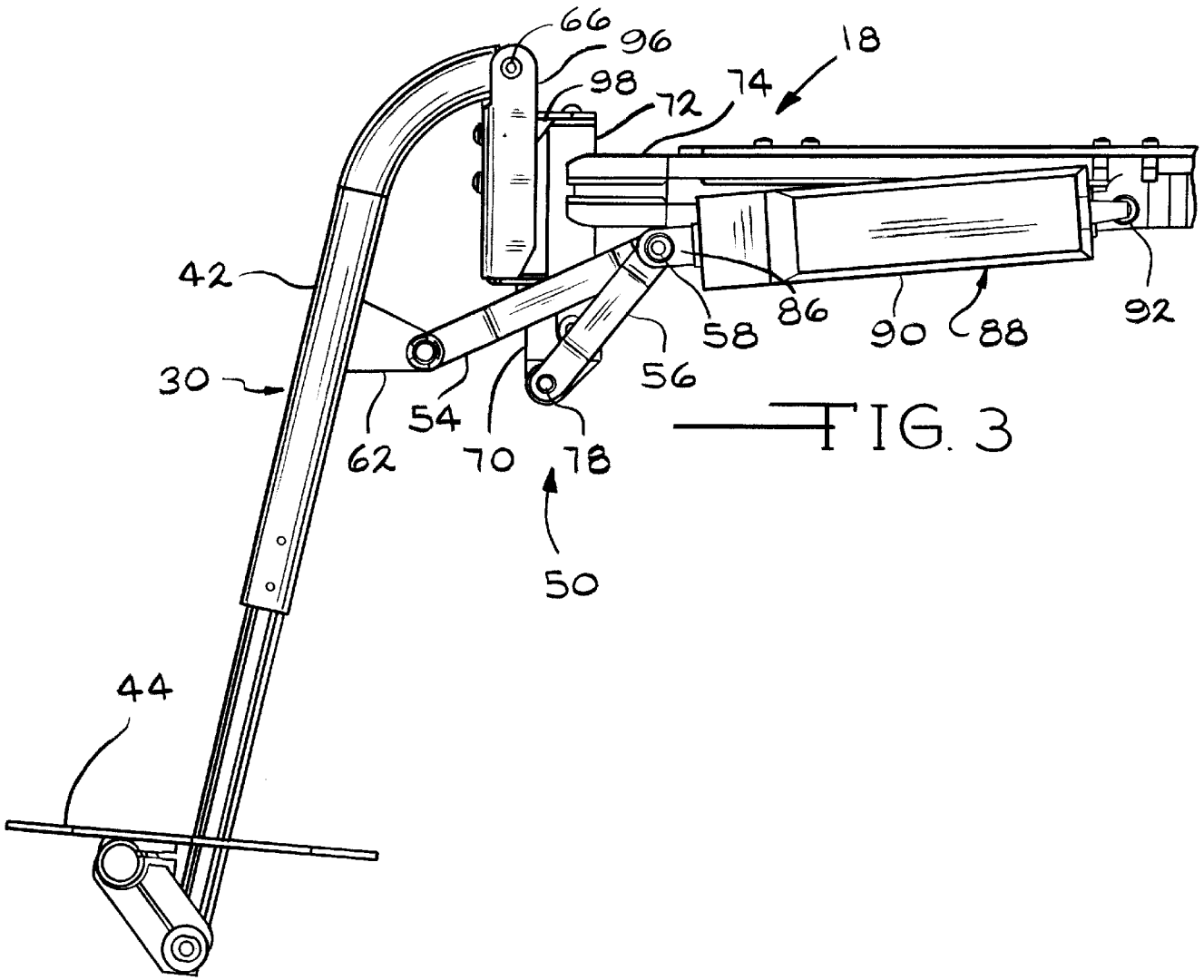
FIG. 3 is schematic view in elevation of the legrest and elevating mechanism of the wheelchair of FIG. 1, with the actuator fully retracted.
Figure 4:
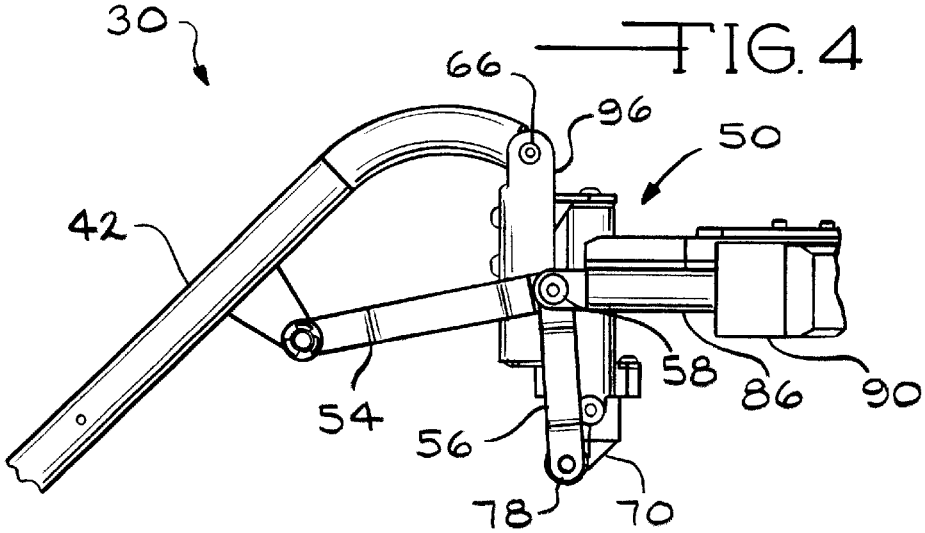
FIG. 4 is a schematic view in elevation of the legrest and elevating mechanism of the wheelchair of FIG. 1, with the actuator partially extended.
Figure 5:
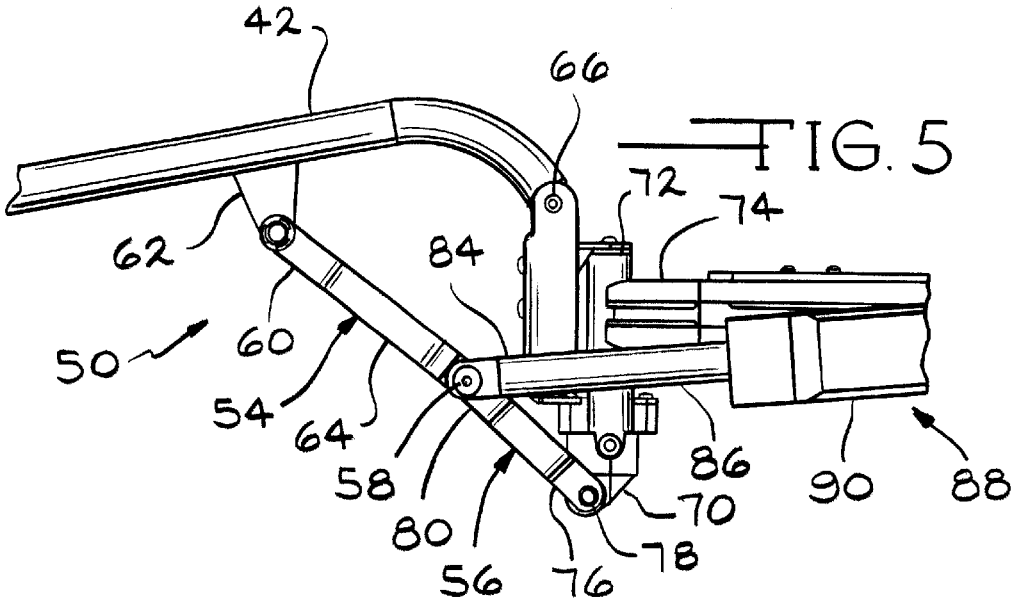
FIG. 5 is a schematic view in elevation of the legrest and elevating mechanism of the wheelchair of FIG. 1, with the actuator fully extended.

As shown in FIGS. 3–5, the elevation mechanism 50 includes a latch link 54, and a pivot link 56. In general, the latch link 54 is connected between the legrest tube 42 and a latch pin 58. More specifically, as shown most clearly in FIG. 5, the latch link 54 has a legrest end 60 that is attached to the legrest tube 42 of the legrest 30 by means of a legrest tube pivot mount 62. The other end of the latch link 54 is pivot end 64, which is attached to the latch pin 58. Therefore, the latch link 54 has a pivoting connection at each end. It can be seen by the progression shown in FIGS. 3–5 that as the latch pin 58 moves forward with respect to the seat frame 18 (i.e., to the left as viewed in FIGS. 3–5), the latch link 54 will force the legrest 30 to rotate or elevate with respect to the seat frame about legrest pivot point 66.

As also shown most clearly in FIG. 5, the pivot link 56 is generally connected between the latch pin 58 and the pivot block 70. The pivot block 70 is mounted on the lower end of the seat rail legrest post 72, which is shown most clearly in FIG. 7. As further shown in FIG. 7, the seat rail legrest post 72 is mounted on the seat rail 74, which is part of the seat frame 18. As most clearly shown in FIG. 5, the pivot link 56 includes a frame end 76 pivotally connected to the pivot block (i.e., indirectly connected to the seat frame) at a block pivot point 78. The pivot link 56 also includes a latch link end 80 pivotally connected to the pivot end 64 of the latch link 56 at the latch pin 58. Therefore, it can be seen that the latch link end 80 of the pivot link 56 and the pivot end 64 of the latch link 54 are pivotally connected through the latch pin 58. When viewing FIGS. 3–5 sequentially, it can be seen that since the block pivot point 78 is stationary with respect to the seat frame, the forward movement of the latch pin 58 can only occur with the latch pin moving in an arc about block pivot point 78. It can be seen from FIGS. 3–5 that the actuator 88, the latch pin 58, the latch link 54 and the pivot link 56 are arranged so that actuation of the actuator 88 rotates the pivot link 56 about its pivotal connection (block pivot point 78) with respect to the seat frame 18, thereby elevating the legrest 30. Also, it can be seen that the latch link 54 and the pivot link 56 are in a folded arrangement about the latch pin when the legrests 30 are in an unelevated position, as shown in FIG. 3, and in an unfolded arrangement when the legrests 30 are in an elevated position, as shown in FIG. 5. In the unfolded arrangement, the latch link and the pivot link are substantially collinear, and substantial portions of the latch link and of the pivot link are substantially aligned. By viewing FIGS. 3–5, it can be seen that the actuator 88, the latch pin 58, the latch link 54 and the pivot link 56 are arranged so that actuation of the actuator 88 unfolds the latch link 54 and the pivot link 56 to the unfolded arrangement, thereby elevating the legrest 30.

As also shown in FIGS. 3–5, the latch pin 58 is positioned at the forward end 84 of the piston 86 of an actuator, indicated generally at 88. The actuator can be any device that moves the piston 86 forward and rearward with respect to the seat frame, and is preferably a linear actuator powered by a motor 90. As shown in FIG. 3 the actuator 88 is mounted at its rearward end at actuator pivot pin 92. Since the latch pin 58 and the forward end 84 of the piston 86 must travel in the arcuate path, the actuator must be able to tip or rotate about the actuator pivot pin 92 to accommodate the vertical component of the latch pin as it travels through the arc.

As can be seen in FIG. 5, when the piston is fully extended the latch link 54 and the pivot link 56 are generally collinear. Since the block pivot point 78 on the pivot block 70 is fixed relative to the seat frame, substantially all of the weight of the legrest 30, and the user's legs, will bear on the pivot block. The force applied to the actuator by the legrests will be largely axial. As the legrests 30 are lowered, the latch link 54 and the pivot link 56 will become less and less collinear, and the axial force on the piston will be increased, since less and less of the force will be borne by the stationary pivot block. However, as the legrests are lowered, the effect of the weight of the legrests and the user's legs will be diminished, with more of the weight being borne by the legrest pivot pin 66.

One of the advantages of the elevation mechanism 50 of the invention is that the actuator can accomplish the elevating of the legrests with a relatively short forward stroke. This is because the linkage arrangement provides an advantageous leverage configuration. In a preferred embodiment of the invention the stroke is no greater than about 5.1 inches. The short stroke is advantageous in the overall wheelchair design because it frees up space on the underside of the wheelchair, particularly in the vertical direction.

Figure 6:
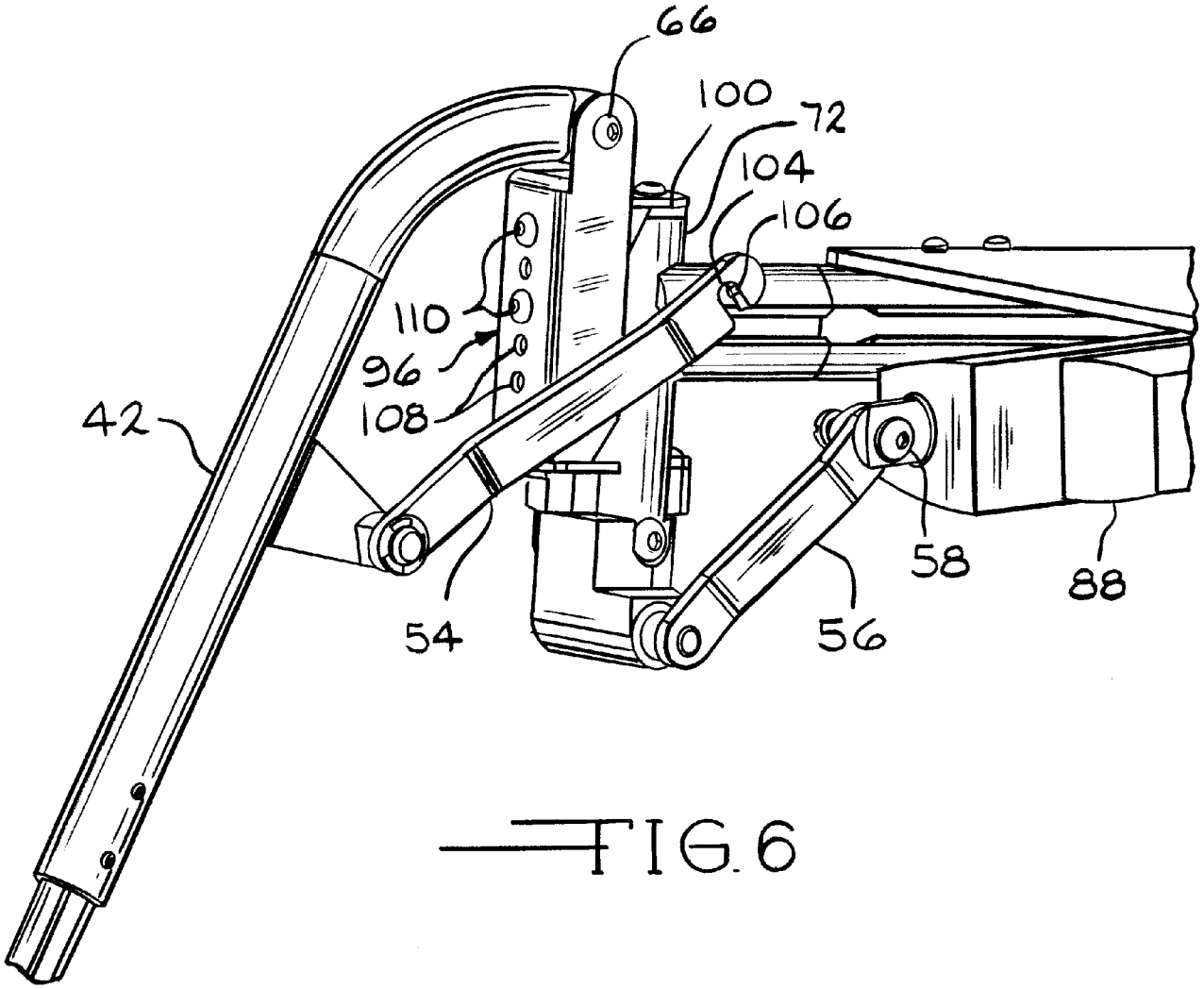
FIG. 6 is a schematic view in perspective of the elevating mechanism with the latch mechanism in an unlatched positioned.
Figure 7:
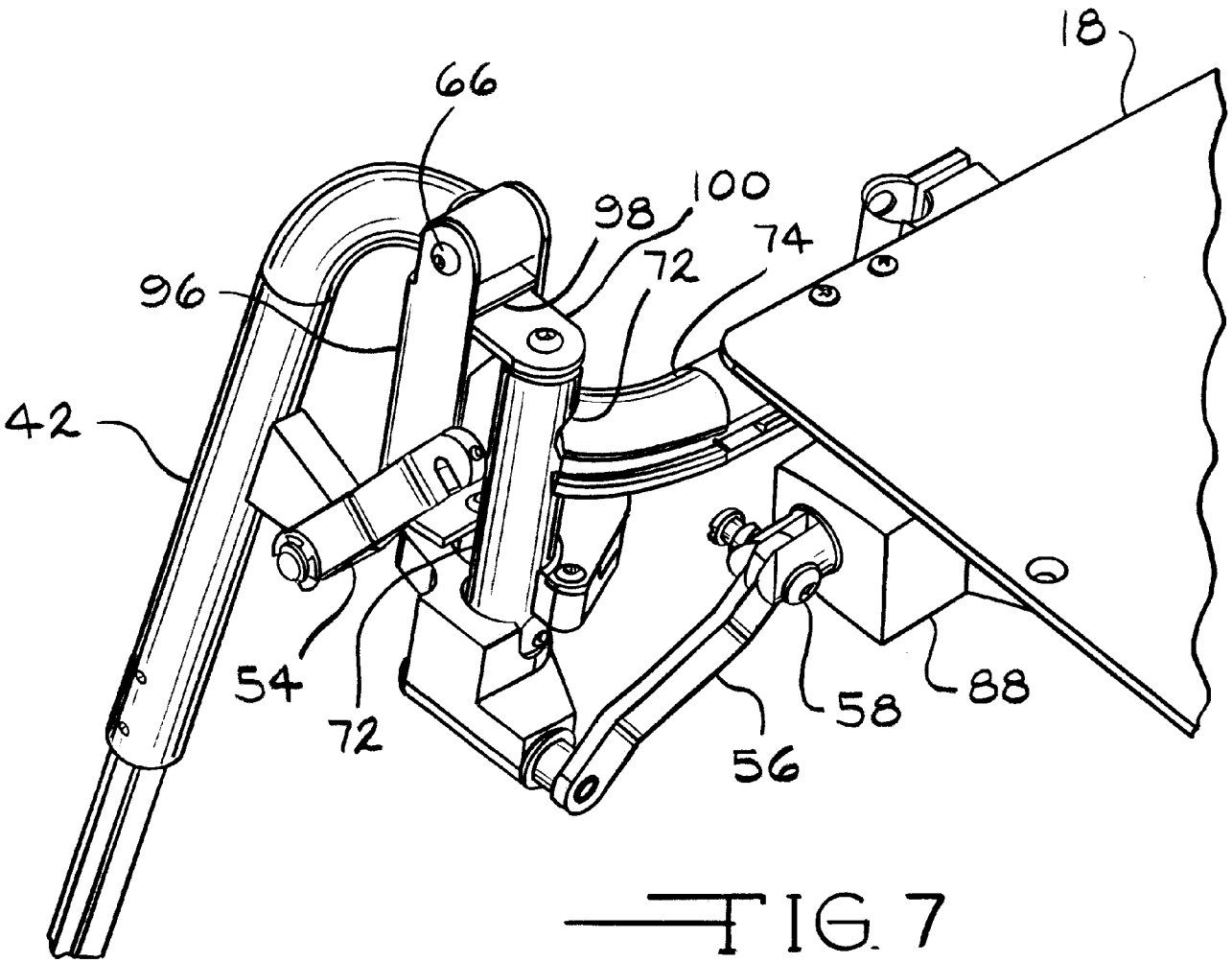
FIG. 7 is a schematic view in perspective of the elevating mechanism with the legrest in a swingaway position.

FIGS. 6 and 7 show the operation of the swing away feature of the legrests 30. The legrest tubes 42 are rotatably mounted at pivot pin 66, which is located in the upper end of the pivot bracket 96. The pivot bracket 96 is itself mounted on swing away block 98. The swing away block 98 is provided with upper and lower tabs 100 extending to the top and bottom of the seat rail legrest post 72 for a rotatable connection. The rotatable connection of the tabs 100 enables the swing away block 98 to swivel laterally about the vertical axis of the seat rail legrest post 72. Since the pivot bracket is mounted on the swing away block, the legrest 30 is also accordingly mounted for swinging away, thereby allowing the wheelchair user to have access to and egress from the wheelchair. One of the advantages of the invention is that it can be readily added to existing legrest posts 72.

In order to allow the legrest to swing away laterally, one of the links of the wheelchair elevation mechanism 50 must be disconnected. For this purpose, the latch link 54 is provided with a releasable connection. This releasable connection could be of any suitable type. A preferred arrangement for the releasable connection is the connection between the pivot end 64 of the latch link 54 and the latch pin 58. The latch can be provided with a slot 104 that sized to fit around the latch pin 58 in a manner that will allow the latch pin and the actuator to push the latch link outward to elevate the legrests, and yet still will allow the latch link to be disconnected when it is necessary to swing the legrests 30 away from the usual position. Preferably, the slot 104 is provided with a detent mechanism 106 to secure the latch link to the latch pin 58. Any other type of mechanism for securing the latch link to the pivot pin could be used. In operation, when it is desired to swing away the legrest 30, the latch link is removed from the pivot pin as shown in FIG. 6, and the legrest can be swung away as shown in FIG. 7.

Although the releasable connection is shown as being at the latch pin 58, it is to be understood that the releasable connection can be at the legrest end of the latch link. In that case, the releasable connection would be from the legrest end 60 of the latch link to the legrest tube pivot mount 62 (i.e., to the legrest).

An important feature of the wheelchair of the invention is that the height of the pivot bracket 96 is adjustable with respect to the swing away block 98. This enables the mounting of the legrest pivot pin to be vertically adjusted relative to the seat frame. This vertical adjustment is independent of the rotational elevation of the legrests 30 about the pivot point 66. This ability to change the starting point or initial resting position of the legrests is of great significance because it makes possible kinematic adjustment of legrest motion to more closely fit the anatomy of the wheelchair user so that the elevational movement of the legrest will approximate the natural physiology of the user's leg.

Figure 8:
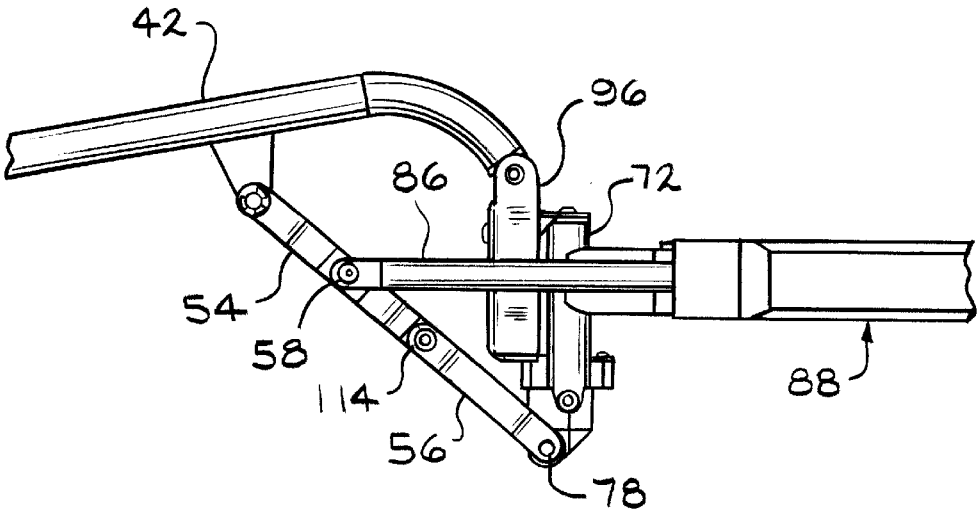
FIG. 8 is a schematic view in elevation of a different arrangement of the linkages in the elevating mechanism according to another embodiment of the invention.
Figure 9:
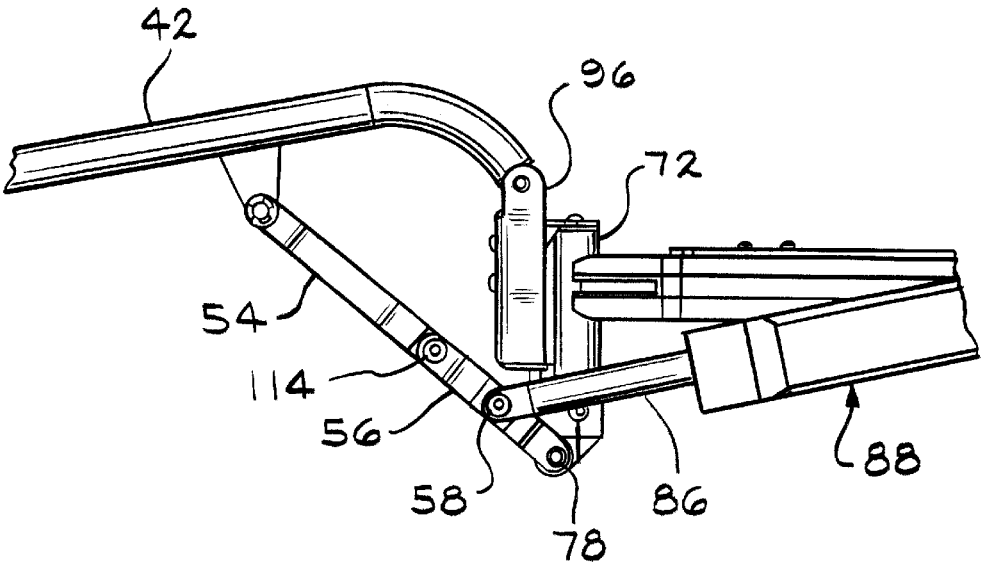
FIG. 9 is a schematic view in elevation of an arrangement of the linkages in the elevating mechanism according to yet another embodiment of the invention.

The vertical adjustability of the height of the pivot point 66 can be accomplished in any of several methods. One such method is shown in FIG. 6, where it can be seen that one face of the pivot bracket 96 is provided with several bolt holes 108. There are corresponding threaded bolt receiving holes, not shown, in the swingaway block 98, and some bolts 110 are inserted into the holes 108 and into the pivot bracket to secure the pivot bracket to the swingaway block. The use of the bolts and holes enables the initial height of the legrest pivot point to be adjusted vertically. As shown in FIG. 8, in an alternate embodiment of the invention the latch pin 58 at the end of the piston 86 can be attached at a point other than at the intersection of the latch link 54 and the pivot link 56. As shown, the latch pin 58 is positioned in an intermediate position of the latch link 54 rather than at the end 64 of the latch link 54. The latch link 54 and the pivot link 56 are still pivotally connected at pivot 114. As also shown in FIG. 9, in another embodiment of the invention, the latch pin 58 can be positioned at an intermediate point on the pivot link 56. In view of these alternate embodiments, the broadest sense, the invention includes an elevation mechanism in which the forward end 84 of the piston 86 is any one of the latch pin, the latch link, and the pivot link.

The principle and mode of operation of this invention have been described in its preferred embodiments. However, it should be noted that this invention may be practiced otherwise than as specifically illustrated and described without departing from its scope.

What is claimed is:

1. A wheelchair having a seat frame with a forward end, legrests pivotally mounted at the forward end of the seat frame for elevation with respect to the seat frame, and an elevation mechanism comprising:

a latch link having a legrest end attached to the legrest, and a pivot end;

a pivot link having a frame end pivotally connected to the seat frame, and having a latch link end pivotally connected to the pivot end of the latch link, where the latch link end of the pivot link and the pivot end of the latch link are pivotally connected through a latch pin; and an actuator movable in a forward direction with respect to the seat frame to pivot the legrests relative to the seat frame, the actuator having a forward end that is connected to one of the latch pin, the latch link, and the pivot link.

2. The wheelchair of claim 1 in which the latch link and the pivot link are mounted so that they are generally collinear when the piston is fully extended.

3. The wheelchair of claim 1 in which the forward end of the piston is connected to the latch pin.

4. The wheelchair of claim 3 in which the connection between the pivot end of the latch link and the latch pin is a releasable connection.

5. The wheelchair of claim 4 in which the releasable connection is a slot in the pivot end of the latch link, with the slot sized to fit around the latch pin.

6. The wheelchair of claim 5 in which the slot includes a detent mechanism to secure the latch link to the latch pin.

7. The wheelchair of claim 4 in which the legrests are pivotally mounted for a swingaway motion so that the legrests can be rotated laterally when the latch link is disconnected from the latch pin.

8. The wheelchair of claim 3 in which the attachment of the legrest end of the latch link to the legrest is a releasable connection.

9. The wheelchair of claim 8 in which the legrests are pivotally mounted for a swingaway motion so that the legrests can be rotated laterally when the latch link is disconnected from the legrest.

10. The wheelchair of claim 8 in which the legrests are pivotally mounted for a swingaway motion so that the legrests can be rotated laterally when the latch link is disconnected from the legrest.

11. The wheelchair of claim 1 in which the actuator is pivotally mounted at a rearward end.

12. The wheelchair of claim 1 in which the actuator is pivotally mounted at a rearward end.

13. The wheelchair of claim 1 in which the actuator has a piston movable in a forward direction with respect to the seat frame to pivot the legrests relative to the seat frame, the piston having a forward end that is connected to one of the latch pin, the latch link, and the pivot link.

14. A wheelchair having a seat frame with a forward end, seat legrest posts at the forward end of the seat frame, and legrests mounted to the seat rail legrest posts for pivoting about a legrest pivot pin for elevation with respect to the seat frame, wherein the pivotal mounting of the legrests with respect to the seat rail legrest posts includes a pivot bracket mounted to the seat rail legrest posts, the pivot bracket being vertically adjustable along a vertical axis of the seat rail legrest posts, thereby enabling the legrest pivot pin to be vertically adjusted relative to the seat frame along the vertical axis of the seat rail legrest posts.

15. The wheelchair of claim 14 including an elevation mechanism comprising:

a latch link having a legrest end attached to the legrest, and a pivot end;

a pivot link having a frame end pivotally connected to the seat frame, and having a latch link end pivotally connected to the pivot end of the latch link, where the latch link end of the pivot link and the pivot end of the latch link are pivotally connected through a latch pin; and an actuator having a piston movable in forward and rearward directions with respect to the seat frame to pivot the legrests relative to the seat frame, the piston having a forward end that is connected to one of the latch pin, the latch link, and the pivot link.

16. The wheelchair of claim 14 in which the latch link and the pivot link are mounted so that they are generally collinear when the piston is fully extended.

17. The wheelchair of claim 14 in which the forward end of the piston is connected to the latch pin.

18. The wheelchair of claim 17 in which the connection between the pivot end of the latch link and the latch pin is a releasable connection.

19. The wheelchair of claim 18 in which the releasable connection is a slot in the pivot end of the latch link, with the slot sized to fit around the latch pin.

20. The wheelchair of claim 19 in which the slot includes a detent mechanism to secure the latch link to the latch pin.

21. The wheelchair of claim 18 in which the legrests are pivotally mounted for a swingaway motion so that the legrests can be rotated laterally when the latch link is disconnected from the latch pin.

22. The wheelchair of claim 17 in which the attachment of the legrest end of the latch link to the legrest is a releasable connection.

23. A wheelchair having a seat frame with a forward end, legrests pivotally mounted at the forward end of the seat frame for elevation with respect to the seat frame, and an elevation mechanism comprising:

a latch link having a legrest end attached to the legrest, and a pivot end;

a pivot link having a frame end pivotally connected to the seat frame, and having a latch link end pivotally connected to the pivot end of the latch link, where the latch link end of the pivot link and the pivot end of the latch link are pivotally connected through a latch pin, with the latch link and the pivot link being in a folded arrangement about the latch pin when the legrests are in an unelevated position and in an unfolded arrangement when the legrests are in an elevated position, wherein in the unfolded arrangement substantial portions of the latch link and of the pivot link are substantially aligned; and an actuator connected to one of the latch pin, the latch link, and the pivot link;

wherein the actuator, the latch pin, the latch link and the pivot link are arranged so that actuation of the actuator unfolds the latch link and the pivot link to the unfolded arrangement, thereby elevating the legrest.

24. The wheelchair of claim 23 in which the latch link and the pivot link are mounted so that they are generally collinear when the piston is fully extended.

25. The wheelchair of claim 23 in which the forward end of the piston is connected to the latch pin.

26. The wheelchair of claim 25 in which the connection between the pivot end of the latch link and the latch pin is a releasable connection.

27. The wheelchair of claim 26 in which the releasable connection is a slot in the pivot end of the latch link, with the slot sized to fit around the latch pin.

28. The wheelchair of claim 27 in which the slot includes a detent mechanism to secure the latch link to the latch pin.

29. The wheelchair of claim 26 in which the legrests are pivotally mounted for a swingaway motion so that the legrests can be rotated laterally when the latch link is disconnected from the latch pin.

30. The wheelchair of claim 25 in which the attachment of the legrest end of the latch link to the legrest is a releasable connection.

31. The wheelchair of claim 30 in which the legrests are pivotally mounted for a swingaway motion so that the legrests can be rotated laterally when the latch link is disconnected from the legrest.

32. The wheelchair of claim 23 in which the actuator is pivotally mounted at a rearward end.

33. The wheelchair of claim 23 in which the actuator has a piston movable in a forward direction with respect to the seat frame to pivot the legrests relative to the seat frame, the piston having a forward end that is connected to one of the latch pin, the latch link, and the pivot link.

34. A wheelchair having a seat frame with a forward end and legrests mounted at the forward end of the seat frame for pivoting about a legrest pin for elevation with respect to the seat frame, wherein the legrest pin is mounted on a pivot bracket attached to the seat frame, and the pivot bracket is mounted for vertical adjustment relative to the seat fame, and wherein the wheelchair further includes an elevation mechanism comprising:

a latch link having a legrest end attached to the legrest, and a pivot end;

a pivot link having a frame end pivotally connected to the seat frame, and having a latch link end pivotally connected to the pivot end of the latch link, where the latch link end of the pivot link and the pivot end of the latch link are pivotally connected through a latch pin; and an actuator having a piston movable in forward and rearward directions with respect to the legrests to pivot the legrests relative to the seat frame, the piston having a forward end that is connected to one of the latch pin, the latch link, and the pivot link.

* * * * *